US010561201B1

(12) United States Patent
Woodbury

(10) Patent No.: US 10,561,201 B1
(45) Date of Patent: Feb. 18, 2020

(54) SHOE WITH DETACHABLE SOCK

(71) Applicant: Margaret Woodbury, White Plains, NY (US)

(72) Inventor: Margaret Woodbury, White Plains, NY (US)

( * ) Notice: Subject to any disclaimer, the term of this patent is extended or adjusted under 35 U.S.C. 154(b) by 0 days.

(21) Appl. No.: 16/119,926

(22) Filed: Aug. 31, 2018

Related U.S. Application Data

(62) Division of application No. 14/887,560, filed on Oct. 20, 2015, now abandoned.

(60) Provisional application No. 62/067,515, filed on Oct. 23, 2014.

(51) Int. Cl.

| | |
|---|---|
| ***A43B 3/10*** | (2006.01) |
| ***A43B 23/28*** | (2006.01) |
| ***A41B 11/12*** | (2006.01) |
| ***A43B 1/00*** | (2006.01) |

(52) U.S. Cl.
CPC ..... *A43B 23/28* (2013.01); *A41B 11/12* (2013.01); *A43B 1/0081* (2013.01); *A43B 3/101* (2013.01)

(58) Field of Classification Search
CPC ..... A43B 23/28; A41B 11/12
USPC ..... 36/9 R, 10
See application file for complete search history.

(56) References Cited

U.S. PATENT DOCUMENTS 2,238,804 A * 4/1941 Brown ..... A41B 11/10 2/240
2,623,374 A * 12/1952 Hinchman ..... D04B 1/26 2/239
2,686,376 A * 8/1954 Burkholz ..... A43B 3/02 36/101
3,274,804 A * 9/1966 Thorneburg ..... A41B 11/00 66/171
3,289,329 A * 12/1966 Weiss ..... A41B 11/00 2/239
3,315,276 A * 4/1967 Thelma ..... A41B 11/00 2/239
3,416,174 A * 12/1968 Novitske ..... A43B 13/32 12/142 E
3,492,674 A * 2/1970 Poole ..... A41B 11/00 2/239
4,055,858 A * 11/1977 Traenkle ..... A41B 11/001 2/240
4,169,324 A * 10/1979 Gibbs ..... A43B 17/18 2/239
4,187,619 A * 2/1980 Gibbs ..... A43B 17/18 2/240
4,575,954 A * 3/1986 Bye ..... A61F 5/0111 2/240
7,434,336 B2 * 10/2008 Kosted ..... A43B 1/0081 36/10
2007/0062067 A1 * 3/2007 Covatch ..... A43B 3/24 36/55

(Continued)

*Primary Examiner* — Ted Kavanaugh
(74) *Attorney, Agent, or Firm* — Oblon, McClelland, Maier & Neustadt, L.L.P.

(57) ABSTRACT

A footwear combination that includes a base shoe that may be combined with plural different fitted socks to accommodate plural outfits, depending upon the fitted sock that is combined with the shoe. The fitted socks are detachable from the shoe (e.g., for washing and change of outfitting). Points of attachment between the sock and shoe extend down to the region of the metatarso-phalangeal joints. This allows the dorsal portion of the foot to remain bare and will allow fashionable women's footwear to be at once comfortable and trendy.

11 Claims, 11 Drawing Sheets

(56) References Cited

U.S. PATENT DOCUMENTS

2015/0305442 A1* 10/2015 Ravindran ..... A43B 23/28
36/138

* cited by examiner

SHOE WITH DETACHABLE SOCK

FIELD OF INVENTION

The present invention is directed to a combination of shoe and detachable sock, and, in one embodiment, to a shoe utilizing fastening devices mounted around or along a rim of the shoe to attach a fitted sock to the shoe to avoid slippage of the sock within the shoe, and allow a single pair of shoes to serve a variety of outfits depending upon the sock used. The shoe will preferably be open on the top (dorsal) foot surface to the area of the metatarso-phalangeal joints (MTPJs). Specifically, the points of attachment will extend down to the region of the MTPJs.

DISCUSSION OF THE BACKGROUND

A combination shoe and detachable sock is configured to enable a sock, extending over the top of the shoe, to become part of the overall ornamental and function design of the shoe while detachably affixing the sock to the shoe. Because of the ability to mate a variety of sock designs to a single shoe base, one base pair of shoes can be utilized with multiple outfits, giving the buyer significant cost savings while providing comfort to the wearer.

BRIEF DESCRIPTION OF THE DRAWINGS

The following description, given with respect to the attached drawings, may be better understood with reference to the non-limiting examples of the drawings, wherein.

DISCUSSION OF THE PREFERRED EMBODIMENTS

Figure 1A:
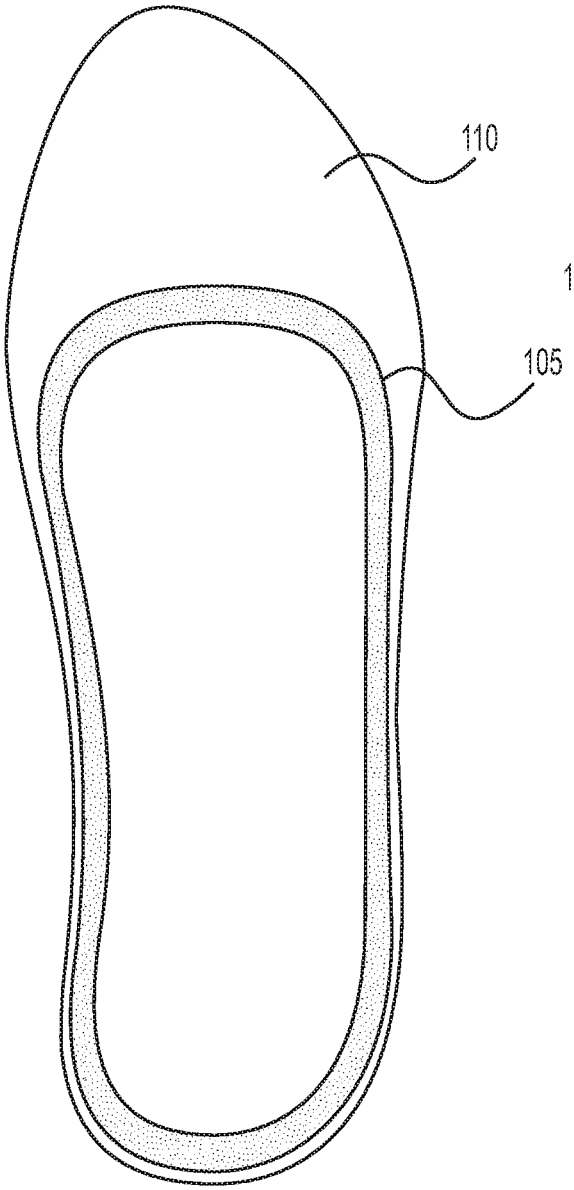
FIG. 1A is a top view of a point-toe ballet flat shoe with a fitted, secured, detachable ballet slip-on sock.
Figure 1B:
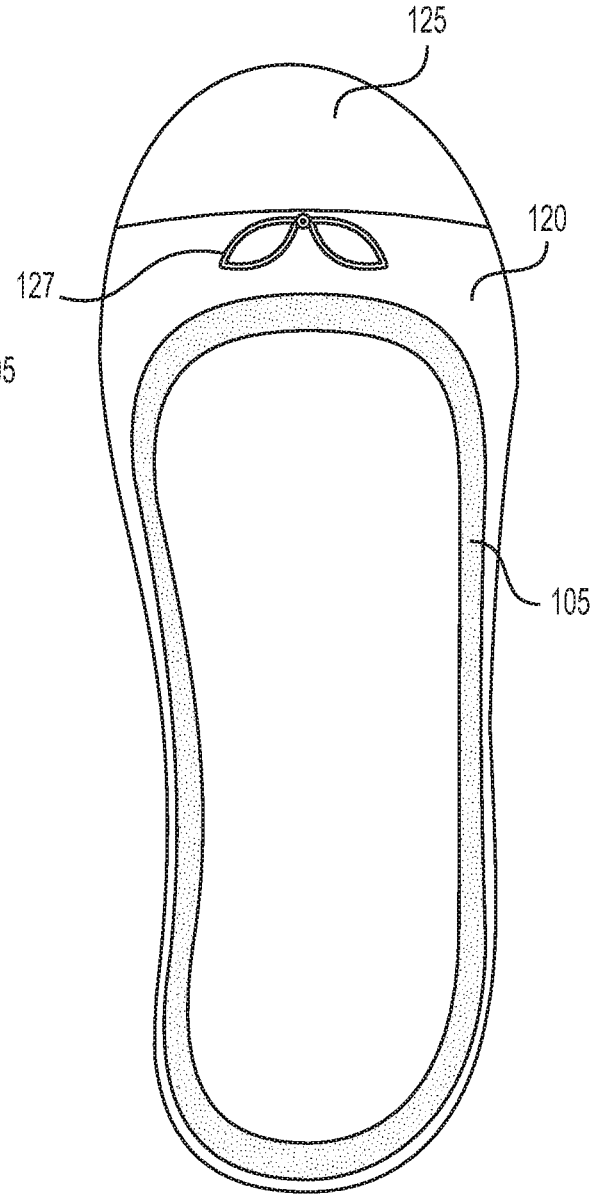
FIG. 1B is a top view of a cap-toe ballet flat shoe with a fitted, secured, detachable ballet slip-on sock.
Figure 7B:
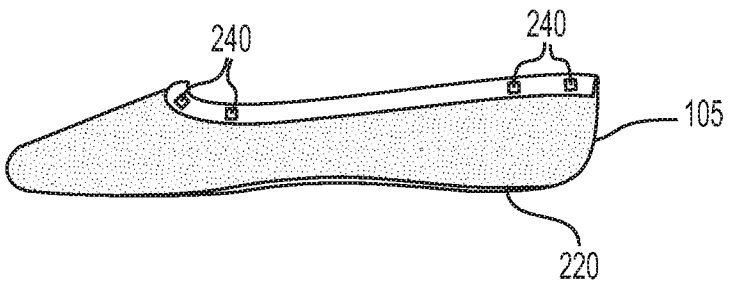
FIGS. 7A and 7B are top and side views, respectively, of a detachable sock including attachments for connecting to shoes, such as in FIGS. 1A-6.

Turning to FIGS. 1A and 1B, a sock 105 is shown inside a shoe 110/120 (such as a flat). The sock 105 is configured to fit to the shape of the shoe 110/120 but extends beyond the rim of the shoe 110/120. Furthermore, the sock 105 includes attachments (such as FIGS. 7A and 7B; 8B and 8D) for attaching to the shoe (e.g., 110/120/180/190) that are sown into the sock 105 or otherwise attached to the sock 105. When combined, the sock 105 is incorporated into the shoe's visual and functional design and fit. The shoe is preferably worn with the attached sock as the open shoe attachments on an outside of the shoe may be unsightly when not mated with paired sock. Preferably shoe 110/120/180/190 is open on the dorsal (top) foot surface to the area of the metatarso-phalangeal joints, thereby allowing for women's footwear that is visually/aesthetically pleasing and promotes foot health, and allows for shoe multiplexing with a variety of outfits giving consumers a cost-savings opportunity, and ease of packing for business or pleasure travel.

As shown in FIGS. 1A and 1B, various styles of ballet flats (e.g., a point-toe ballet flat 110 and a cap-toe ballet flat 120, respectively) can be fitted to cooperate with a sock 105. The sock 105 snaps off, unhooks, unbuttons, unties, de-Velcros or otherwise disconnects from the shoe for interchangeable outfitting and easy washing of socks. The socks may be manufactured in a number of styles and prints that nonetheless attach to the same base shoe.

As shown in FIGS. 2A-2D, when the sock 105 is removed from the shoe 120, a number of different fastening devices for fastening the sock 105 along or around the rim of the opening of the shoe 120 are exposed in the direction of an exterior of the shoe 120. (The rim of the opening of the shoe is considered the rim whether it is the main shoe body, or any added band of fabric or elastic or other material appended to the rim of the opening of the shoe body.) Fastening devices for fastening the sock 105 along or around the rim of the opening of the shoe 120 include, but are not limited to, snaps 130 (FIG. 2A), hooks 140 (FIG. 2B), buttons 150 (FIG. 2C), ribbons 160 (FIG. 2D), and Velcro 170 (FIGS. 8A and 8C), any of which can be made to face toward an interior or exterior of the shoe or face toward the opening of the shoe. Each of the fastening devices (130/140/150/160/170) for fastening the sock 105 along or around the opening of the shoe 120 are configured to be placed in locations along or around the opening of the shoe that correspond to attachments 230/240/250 (FIGS. 7A, 7B, and 8D) in or on the sock that is to be worn with the shoe. (In the case of continuous Velcro loop (FIGS. 8A and 8B) attachment is continuous loop of Velcro on both sock and shoe.) In an alternative embodiment, the fastening devices (130/140/150/160/170) are affixed to the sock and the shoe instead includes the mated attachments such as (230/240/250).

Figure 2A:
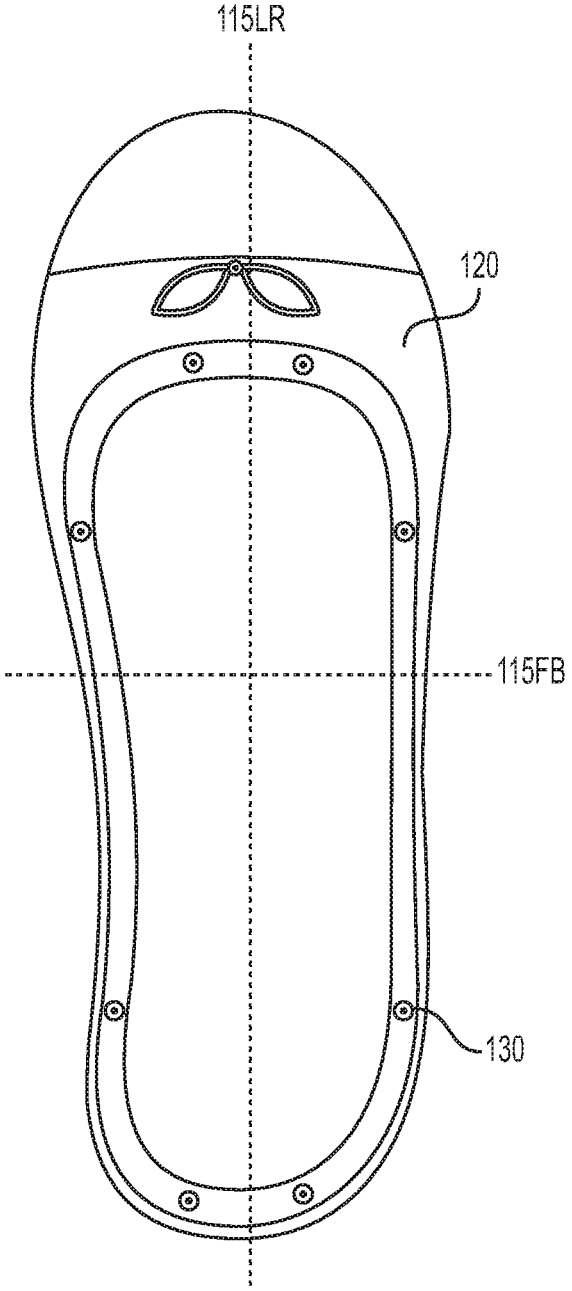
FIGS. 2A-2D are top views of the shoe of FIG. 1B without the sock being attached to the shoe and are configured to attach to socks using snaps, hooks, buttons and ribbons, respectively.

As shown in FIG. 2A, the shoe 120 can logically be divided into left and right sides of a hypothetical center line 115LR. Similarly, the shoe 120 can be divided into front and back portions of a hypothetical middle line 115FB. As shown in FIG. 2A, there are at least two fastening devices on each of the left and right sides (i.e., on opposite sides of 115LR) and at least two fastening devices on each of the front and back portions (i.e., on opposite sides of 115FB). This enables the sock 105 to remain fixedly oriented within the shoe 120. Using a clock face for reference, where the center of the toes has a reference location of 12 o'clock and a center of the heel has a reference location of 6 o'clock, fastening devices (apart from a continuous strip of Velcro)

would be set at approximately the following positions on the shoe: 11 and 1; 2:30 and 9:30; 4 and 8; 5 and 7 or 5:30 and 6:30, depending upon the shoe style. Additionally certain shoe styles may require up to an extra 4 fastening devices, one on each place that 115LR and 116FB meet the rim (see, e.g., FIG. 2E where additional snaps are used as a non-limiting example of any of the fastening devices). For Velcro designs that do not have continuous loop of Velcro around the rim of shoe, as in FIG. 8A, a combination of strips and points may be used to allow for increased flexibility in attachment. For example, Velcro attachments such as those depicted in FIG. 8C may be used where strips for (multiple attachments) extend from ~10:30 to 1:30 and from ~4:30 to 7:30, but smaller areas of Velcro are used at ~2:30, 9:30, 4 and 8 (for single attachments). This would amount to six separate points of Velcro attachments. In an embodiment using separate Velcro points or strips, additional fastening points of attachment (e.g., two) may be used on opposite sides of 115FB (for a total of eight separate Velcro attachments). Alternately rather than multiple attachments on each side of 115LR, a single Velcro strip might be used on each side, bringing the total Velcro attachment sites on the shoe to four. Lastly, two long U-shaped Velcro attachments might be used—front and back, for a total of two Velcro attachment sites on the shoe.

Figure 3:
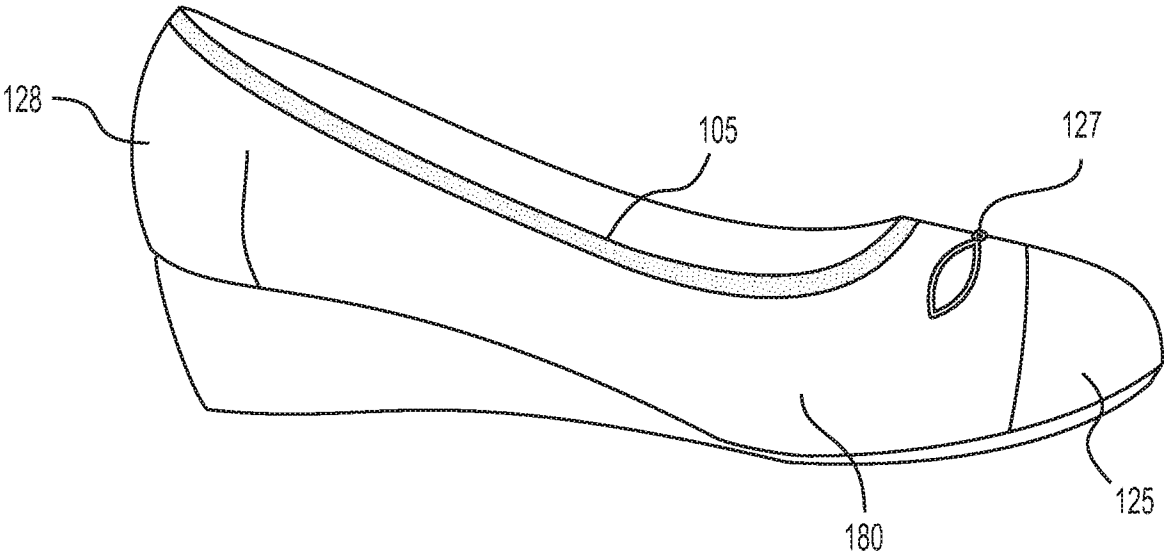
FIG. 3 is a side view of shoe with a wedge heel and a fitted/attached sock.
Figure 4B:
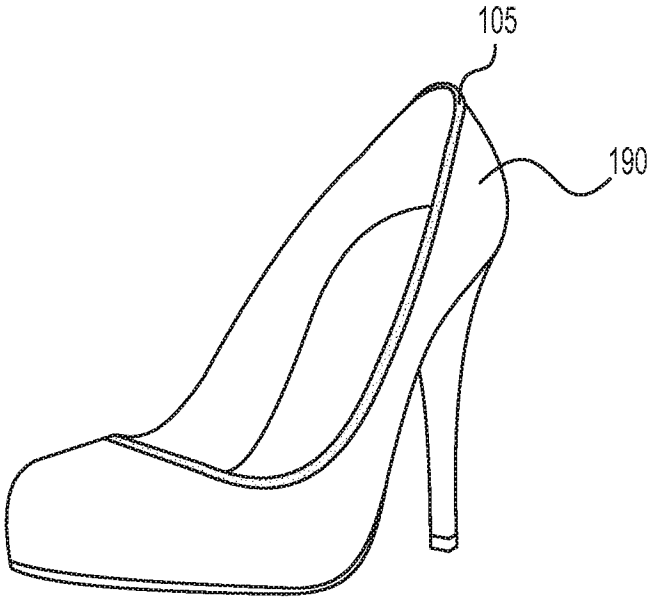
FIGS. 4A and 4B show right and left side views, respectively, of a pump shoe with high heel with fitted/attached sock.
Figure 4A:
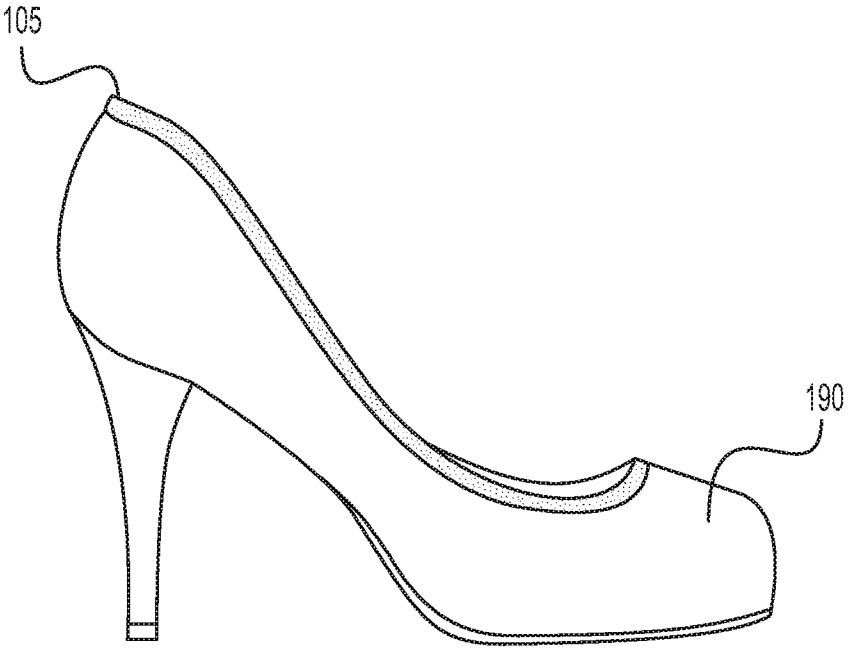
Figure 5:
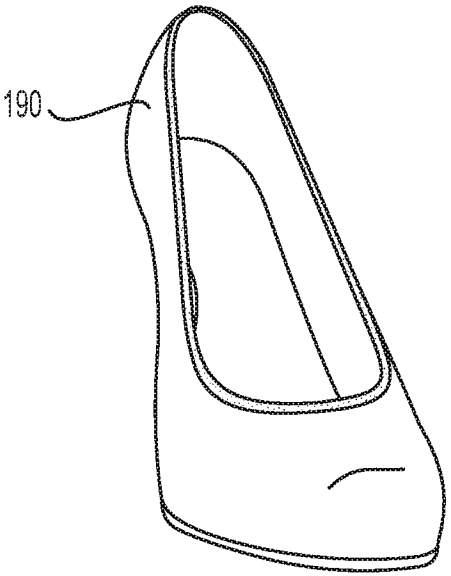
FIG. 5 is a top view of the pump with fitted sock of FIGS. 4A and 4B.

As shown in FIGS. 3-5, a shoe with fastening devices attached to a sock need not be a flat shoe (also known as "a flat"). Instead, the shoe 180/190 may include a heel (e.g., a wedge heel or a separate heel). Further, the shoe 110/120/180/190 may include decorations or enhancements on the shoe (e.g., a glossy cap 125, a bow or other ornament 127, and/or a glossy or accented back 128). The sock 105 is preferably configured to extend over the rim of the shoe to hid or reduce the appearance of the fastening devices (130/140/150/160/170) underneath the sock.

Figure 2B:
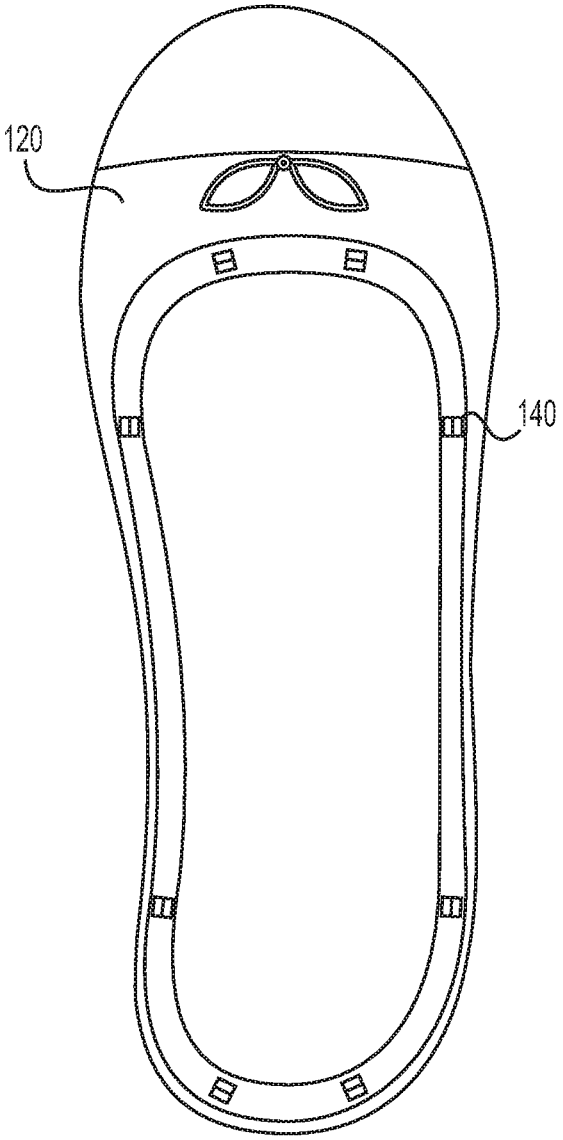
Figure 2C:
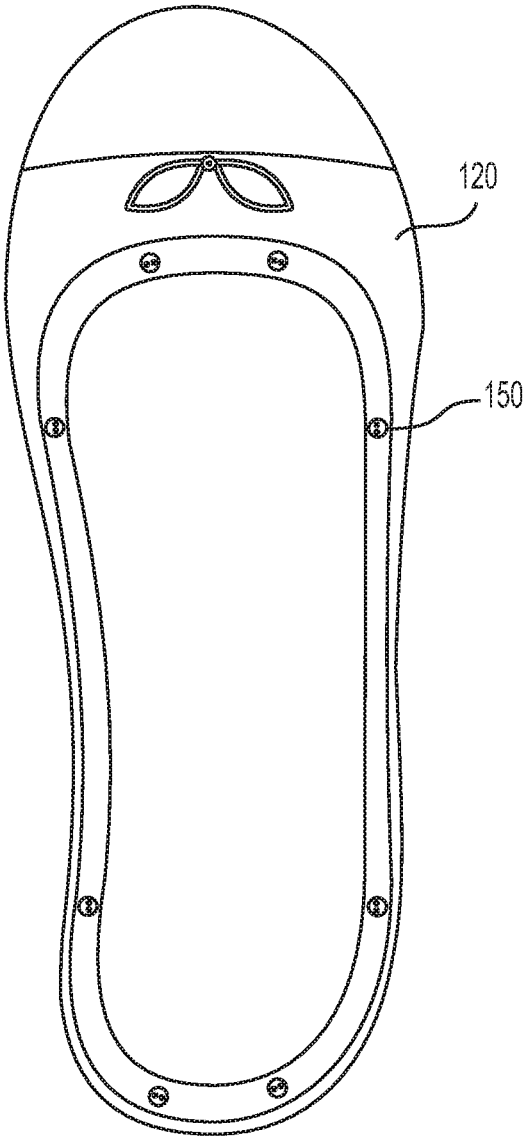
Figure 2D:
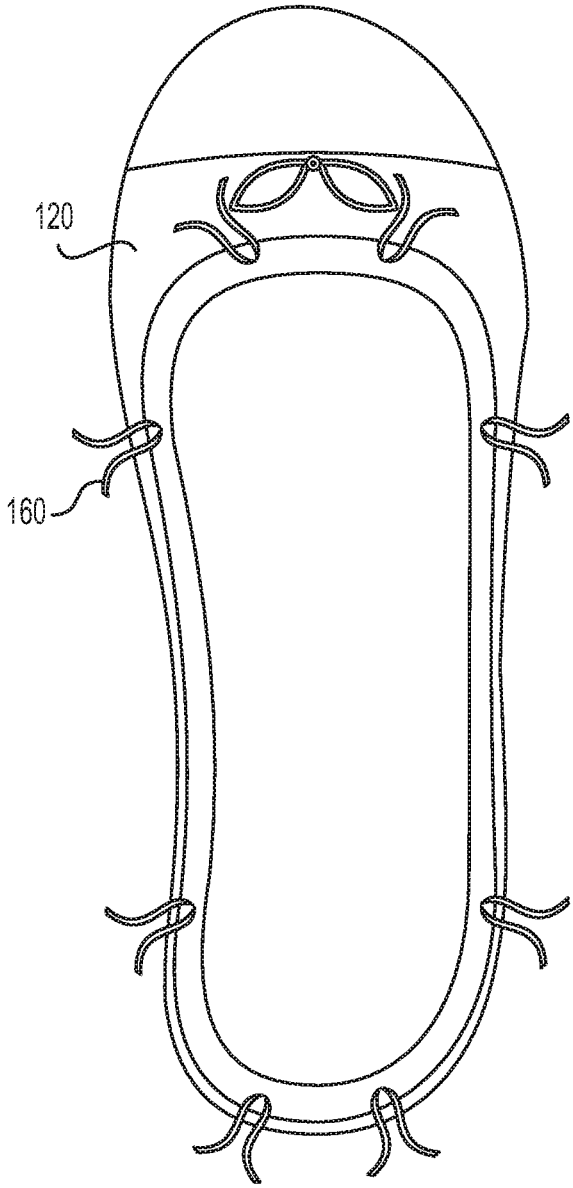
Figure 2E:
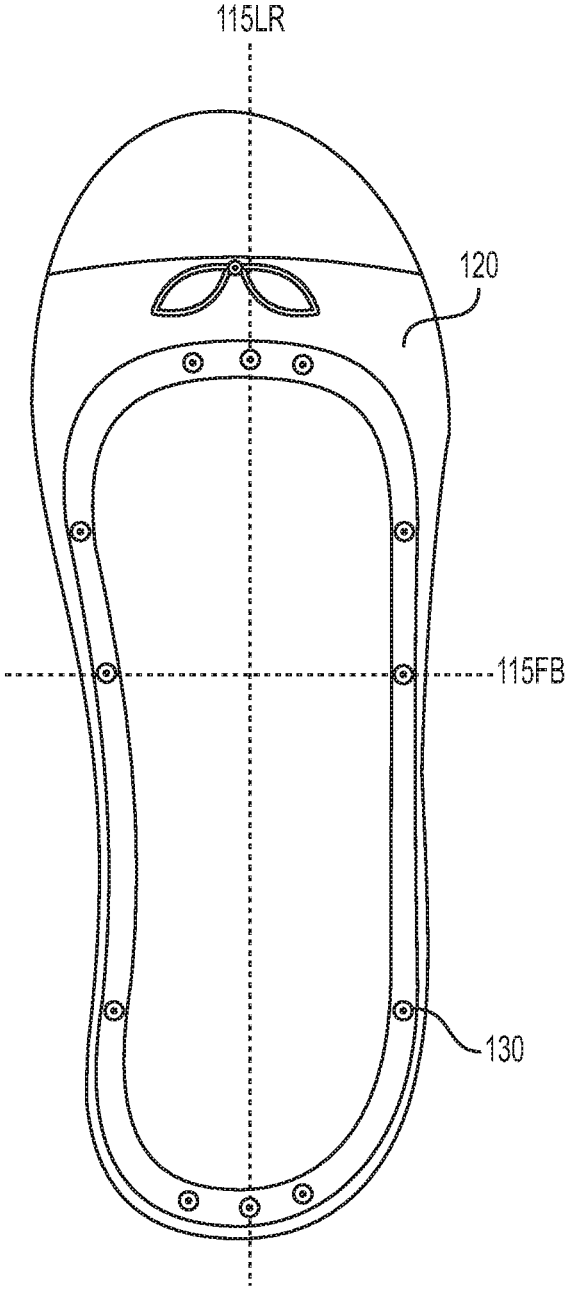
FIG. 2E is a top view of the shoe of FIG. 1B without the sock being attached to the shoe and is configured to attach to socks using additional snaps as compared to FIG. 2A)
Figure 6:
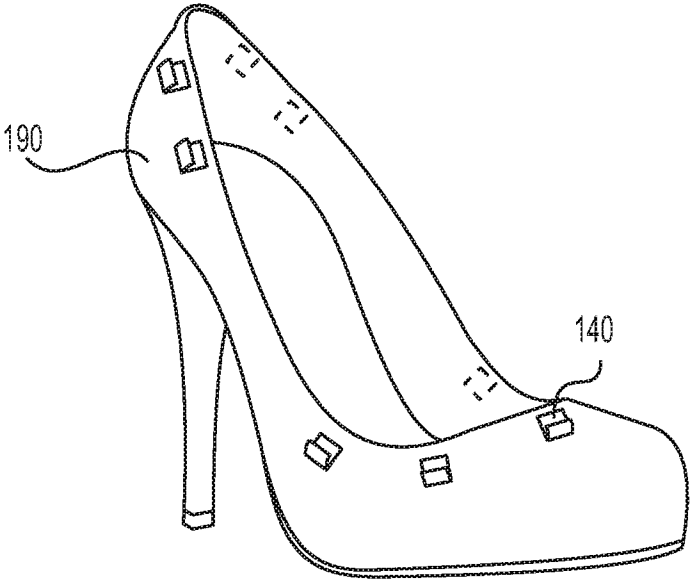
FIG. 6 is a top/side view of the pump of FIGS. 4A and 4B without the sock and showing the placement of 8 hooks on the shoe.
Figure 7A:
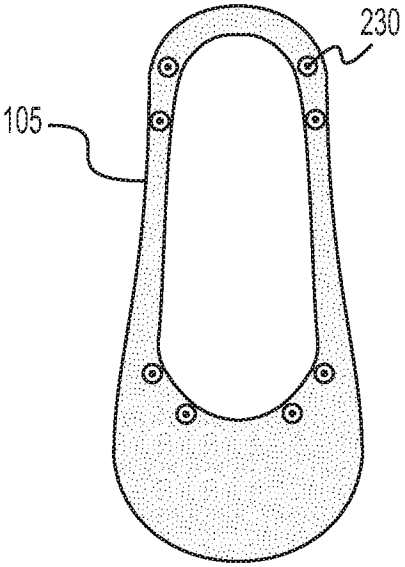
Figure 8A:
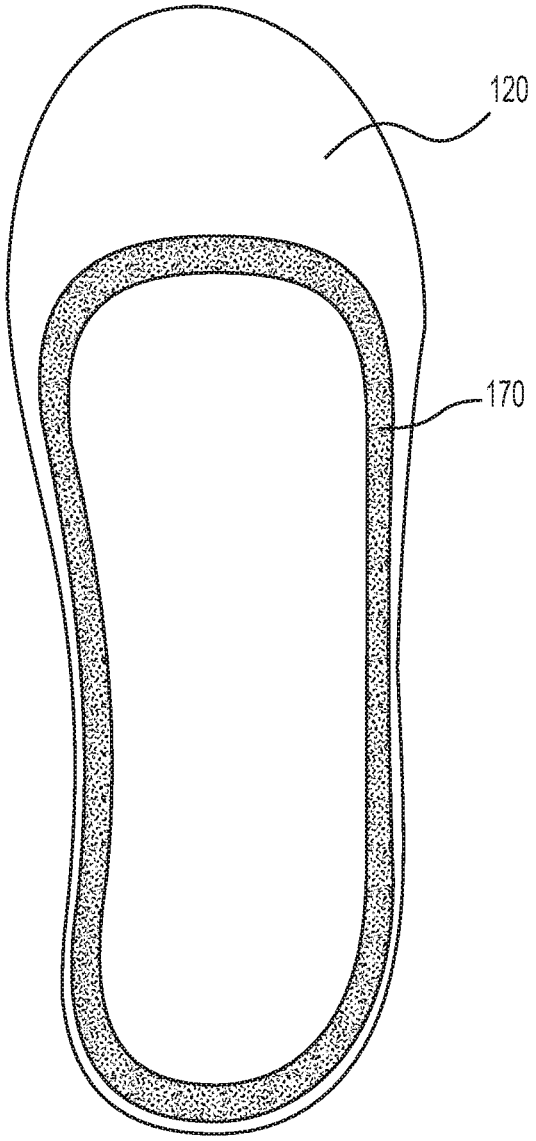
FIG. 8A is a top view of a shoe (without its corresponding sock) using a continuous loop of Velcro as a fastening device around an outer rim of a shoe.
Figure 8B:
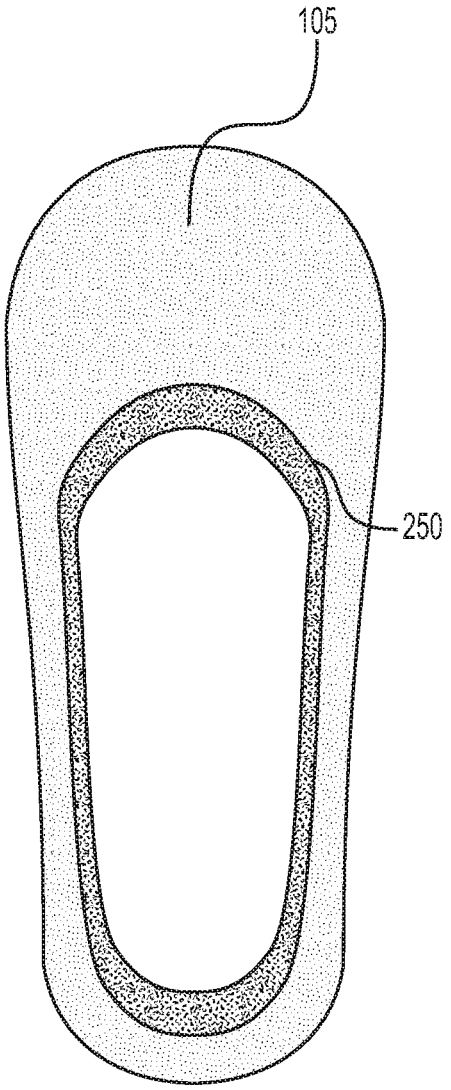
FIG. 8B is top view of detachable sock using a continuous loop of Velcro for connecting to a shoe such as in FIG. 8A.
Figure 8C:
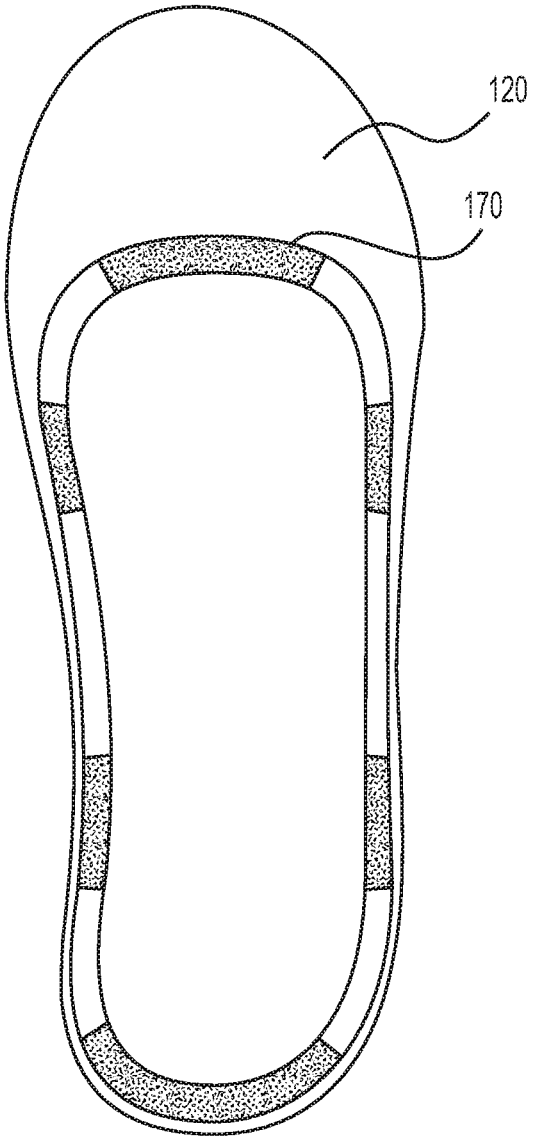
FIG. 8C is a top view of a shoe (without its corresponding sock) using multiple separate sections of Velcro as fastening devices around an outer rim of a shoe.
Figure 8D:
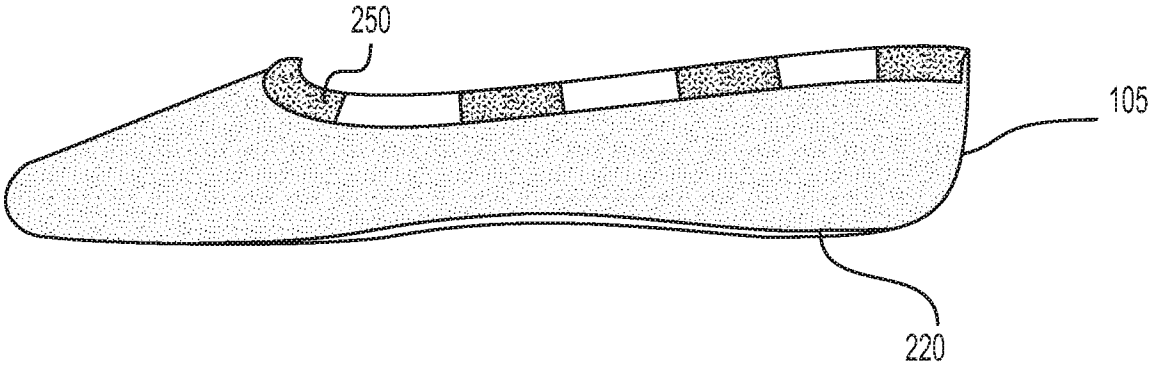
FIG. 8D is side view of a detachable sock using discrete Velcro attachments for connecting to a shoe, such as in FIGS. 8A and 8C.

As shown in FIG. 6, a number of fastening devices (e.g., 8 hooks 140) are configured at a rim of the shoe such that a sock may be detachably attached to the shoe to reduce shifting of the sock within the shoe. FIG. 7A illustrates a detachable sock 105 that fits into and onto a corresponding shoe. Each shoe design may have a fitted sock for that specific design e.g., ballet socks for the ballet shoe designs, pump socks for the pump shoe design. As shown in FIG. 7A, a series of snaps 230 are sown into a sock 105 in locations that correspond to matching snaps 130 in shoe 120 (FIG. 2A). Alternatively, other fastening devices, such as the hook mate 240 may be sown into a sock 105 in locations that correspond to matching hooks 140 in shoe 120 (FIG. 2B). As shown in the side view of FIG. 7B, half of the hooks mates 240 may be sown into one side of the sock and the other half of the hook mates (not shown) are sown into the opposite side, which would be a mirror image to FIG. 7B. As would be appreciated by those of skill in the art, a detachable sock may also have button holes or tie holes to mate with buttons (FIG. 2C) or ribbons (FIG. 2D) attached to the shoe. As described above, in an alternative embodiment, the fastening devices (130/140/150/160/170) are affixed to the sock, and the shoe instead includes the mated attachments such as (230/240/250). In such an alternate embodiment, the shoe may alternately include a series of holes (e.g., for receiving corresponding hooks, threads, or buttons) such that the shoe may be less conspicuously worn without a sock if need be. In general, matching sets of fastening devices and attachments will be referred to herein as "fastening/attachment devices" for ease of discussion.

The sock may further include a padding 220 near a lower surface of the sock for additional comfort.

While the above has been discussed with respect to exemplary numbers of fastening devices and attachment points, other number of fastening devices and attachment points (e.g., 5 or 7) may be utilized. Moreover, while symmetric locations for fastening devices and attachment points have been illustrated in the examples herein, asymmetric locations for fastening devices and attachment points can also be used based on the shape of the rim of the shoe.

Because the sock extends over the top rim of the shoe, the combination sock and shoe will allow more comfortable walking and reduce foot odor and moisture leading to fungal growth. However, because the sock can be changed without changing the shoe, the wearer is provided a stylish shoe that can be used with a variety of outfits. For example: a black base ballet flat shoe could be worn with a simple matching black fitted-to-the-shoe sock; or, that same black base flat shoe could be worn with a tiger strip fitted sock, or tan fitted sock, etc. A white base ballet flat might be paired with a navy blue fitted sock. Or a floral pump might be paired with a solid color sock. This would allow one shoe to serve as a base for many different outfits, reducing long-term costs and allowing travelers to pack one base pair shoe set and bring along a number of different fitted socks to allow for lighter air travel.

In yet another embodiment of the invention, the Velcro fastening devices 190 may be placed under the rim of the shoe (facing an interior of the shoe) or on the edge of the rim of the shoe (facing into the opening of the shoe) as opposed to along the outer rim of the shoe. In such a configuration, the corresponding detachable socks include their attachment points at locations configured to match the corresponding locations of the fastening devices.

While certain configurations of structures have been illustrated for the purposes of presenting the basic structures of the present invention, one of ordinary skill in the art will appreciate that other variations are possible which would still fall within the scope of the appended claims.

The invention claimed is:

1. A combination shoe and sock, comprising:

a tongue-less shoe body having a sole and a rim at an opening of the shoe body, wherein the opening is configured to receive a foot of a wearer of the shoe and adapted to expose a top of the foot where metatarso-phalangeal joints of the foot rest in the shoe when the shoe is worn by a wearer of that sized shoe;

a sock to be worn with the shoe;

first, second, third and fourth fastening/attachment devices are attached around the rim of the shoe for detachably connecting to the sock, wherein the first fastening/attachment device is attached on the outside of the shoe along a left side of the rim, the second fastening/attachment device is attached on the outside of the shoe along a right side of the rim, the third fastening/attachment device is attached on the outside of the shoe on a back portion of the rim, and the fourth fastening/attachment device is attached on the outside of the shoe on a front portion of the rim adapted to be proximate to where metatarso-phalangeal joints of the foot of the wearer of that sized shoe rest in the shoe when the shoe is worn, wherein the sock comprises fifth, sixth, seventh, and eighth fastening/attachment devices at locations corresponding to locations of the first, second, third and fourth fastening/attachment devices, respectively, on the shoe, and wherein the sock is configured to extend underneath a foot of the wearer of the shoe and a top of the sock extends over the rim of the shoe hiding the first, second, third and fourth fastening/attachment devices from view when the sock is attached to the shoe.

2. The combination shoe and sock as claimed in claim 1, wherein the fifth, sixth, seventh, and eighth fastening/attachment devices comprise snaps.

3. The combination shoe and sock as claimed in claim 2, wherein the first, second, third and fourth fastening/attachment devices comprise snaps.

4. The combination shoe and sock as claimed in claim 1, wherein the fifth, sixth, seventh, and eighth fastening/attachment devices comprise hook mates.

5. The combination shoe and sock as claimed in claim 4, wherein the first, second, third and fourth fastening/attachment devices comprise hooks.

6. The combination shoe and sock as claimed in claim 1, wherein the fifth, sixth, seventh, and eighth fastening/attachment devices comprise button holes.

7. The combination shoe and sock as claimed in claim 6, wherein the first, second, third and fourth fastening/attachment devices comprise buttons.

8. The combination shoe and sock as claimed in claim 1, wherein the fifth, sixth, seventh, and eighth fastening/attachment devices comprise tie holes.

9. The combination shoe and sock as claimed in claim 8, wherein the first, second, third and fourth fastening/attachment devices comprise ribbons.

10. The combination shoe and sock as claimed in claim 1, further comprising:

ninth, tenth, eleventh and twelfth fastening/attachment devices are attached around the rim of the shoe for detachably connecting to the sock, wherein the ninth fastening/attachment device is attached on the outside of the shoe along a left side of the rim, the tenth fastening/attachment device is attached on the outside of the shoe along a right side of the rim, the eleventh fastening/attachment device is attached on the outside of the shoe on a back portion of the rim, and the twelfth fastening/attachment device is attached on the outside of the shoe on a front portion of the rim adapted to be proximate to where metatarso-phalangeal joints of the foot of the wearer of that sized shoe rest in the shoe when the shoe is worn, thirteenth, fourteenth, fifteenth, and sixteenth fastening/attachment devices on the sock at locations corresponding to locations of the ninth, tenth, eleventh and twelfth fastening/attachment devices, respectively, on the shoe, wherein the first and ninth fastening/attachment devices are located on opposite sides of a front/back axis of symmetry of the shoe;

wherein the second and tenth fastening/attachment devices are located on opposite sides of the front/back axis of symmetry of the shoe;

wherein the third and eleventh fastening/attachment devices are located on opposite sides of a left/right axis of symmetry of the shoe;

wherein the fourth and twelfth fastening/attachment devices are located on opposite sides of the left/right axis of symmetry of the shoe;

wherein the sock extends over the rim of the shoe hiding the ninth, tenth, eleventh and twelfth fastening/attachment devices from view when the sock is attached to the shoe.

11. The combination shoe and sock as claimed in claim 1, further comprising:

ninth, tenth, eleventh and twelfth fastening/attachment devices are attached around the rim of the shoe for detachably connecting to the sock, wherein the ninth fastening/attachment device is attached on the outside of the shoe along a left side of the rim, the tenth fastening/attachment device is attached on the outside of the shoe along a right side of the rim, the eleventh fastening/attachment device is attached on the outside of the shoe on a back portion of the rim, and the twelfth fastening/attachment device is attached on the outside of the shoe on a front portion of the rim adapted to be proximate to where metatarso-phalangeal joints of the foot of the wearer of that sized shoe rest in the shoe when the shoe is worn, thirteenth, fourteenth, fifteenth, and sixteenth fastening/attachment devices on the sock at locations corresponding to locations of the ninth, tenth, eleventh and twelfth fastening/attachment devices, respectively, on the shoe, wherein the sock extends over the rim of the shoe hiding the ninth, tenth, eleventh and twelfth fastening/attachment devices from view when the sock is attached to the shoe.

* * * * *